US009973857B2

(12) United States Patent
Tokuhisa et al.

(10) Patent No.: US 9,973,857 B2
(45) Date of Patent: May 15, 2018

(54) PIEZOELECTRIC SPEAKER AND ELECTROACOUSTIC TRANSDUCER

(71) Applicant: TAIYO YUDEN CO., LTD., Taito-ku, Tokyo (JP)

(72) Inventors: Yasukazu Tokuhisa, Takasaki (JP); Takashi Tomita, Takasaki (JP); Hiroshi Hamada, Takasaki (JP); Shigeo Ishii, Takasaki (JP); Yutaka Doshida, Takasaki (JP); Yoshiyuki Watanabe, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 141 days.

(21) Appl. No.: 14/970,461

(22) Filed: Dec. 15, 2015

(65) Prior Publication Data

US 2016/0183006 A1 Jun. 23, 2016

(30) Foreign Application Priority Data

Dec. 17, 2014 (JP) ..... 2014-255300

(51) Int. Cl.
*H04R 25/00* (2006.01)
*H04R 17/00* (2006.01)
*H04R 1/06* (2006.01)

(52) U.S. Cl.
CPC ..... *H04R 17/005* (2013.01); *H04R 1/06* (2013.01)

(58) Field of Classification Search
CPC ..... H04R 17/005; H04R 1/06
USPC ..... 381/380, 372, 190; 310/348, 324, 322
See application file for complete search history.

(56) References Cited

U.S. PATENT DOCUMENTS 2,493,734 A * 1/1950 Pearson ..... H04R 11/06 381/328
3,324,253 A * 6/1967 Masahiko ..... H04R 11/06 381/189
4,283,605 A * 8/1981 Nakajima ..... H04R 7/26 381/190
4,295,373 A * 10/1981 Moffatt ..... G01P 3/26 29/25.35
4,330,729 A * 5/1982 Byrne ..... G10K 13/00 310/322
4,418,248 A * 11/1983 Mathis ..... H04R 1/26 381/190

(Continued)

FOREIGN PATENT DOCUMENTS

JP 2013150305 A 8/2013

*Primary Examiner* — Davetta W Goins
*Assistant Examiner* — Phylesha Dabney
(74) *Attorney, Agent, or Firm* — Law Office of Katsuhiro Arai

(57) ABSTRACT

A piezoelectric speaker has a piezoelectric element and vibration plate. The piezoelectric element has a base body with a mounting surface, as well as first and second terminals that are formed on the mounting surface with a distance between them. The vibration plate has a conductive body joined to the piezoelectric element and having a principle surface facing the mounting surface, as well as a first hole with or without a bottom which is formed on the principle surface in a region facing the first terminal to form a space between the body and first terminal. The piezoelectric speaker is capable of preventing the external electrodes of the piezoelectric element from shorting to each other.

18 Claims, 12 Drawing Sheets

(56) References Cited

U.S. PATENT DOCUMENTS

| | | | | |
|---|---|---|---|---|
| 4,742,264 | A * | 5/1988 | Ogawa | H04R 17/00 310/332 |
| 4,755,975 | A * | 7/1988 | Ito | H04R 17/00 310/322 |
| 4,965,483 | A * | 10/1990 | Abe | G10K 9/122 310/324 |
| 5,405,476 | A * | 4/1995 | Knecht | H03H 9/1014 156/292 |
| 5,430,803 | A * | 7/1995 | Kimura | H04R 1/46 381/190 |
| 5,802,195 | A * | 9/1998 | Regan | H04R 17/00 310/324 |
| 6,445,108 | B1 * | 9/2002 | Takeshima | B06B 1/0603 310/322 |
| 6,472,797 | B1 * | 10/2002 | Kishimoto | H04R 17/00 310/324 |
| 8,447,061 | B2 * | 5/2013 | Lee | H04R 1/1091 381/181 |
| 9,503,805 | B2 * | 11/2016 | Huang | H04R 1/10 |
| 9,601,682 | B2 * | 3/2017 | Ishii | H01L 41/053 |
| 9,654,881 | B2 * | 5/2017 | Ishii | H04R 17/00 |
| 9,686,615 | B2 * | 6/2017 | Doshida | H04R 17/00 |
| 2002/0130589 | A1 * | 9/2002 | Hamada | H04R 17/00 310/324 |
| 2005/0023937 | A1 * | 2/2005 | Sashida | B06B 1/0611 310/348 |
| 2016/0119719 | A1 | 4/2016 | Doshida et al. | |
| 2016/0119720 | A1 | 4/2016 | Doshida et al. | |
| 2016/0119721 | A1 | 4/2016 | Doshida et al. | |
| 2016/0155926 | A1 | 6/2016 | Ishii et al. | |
| 2016/0157020 | A1 | 6/2016 | Ishii et al. | |
| 2016/0157021 | A1 | 6/2016 | Ishii et al. | |

* cited by examiner

[Fig. 1]
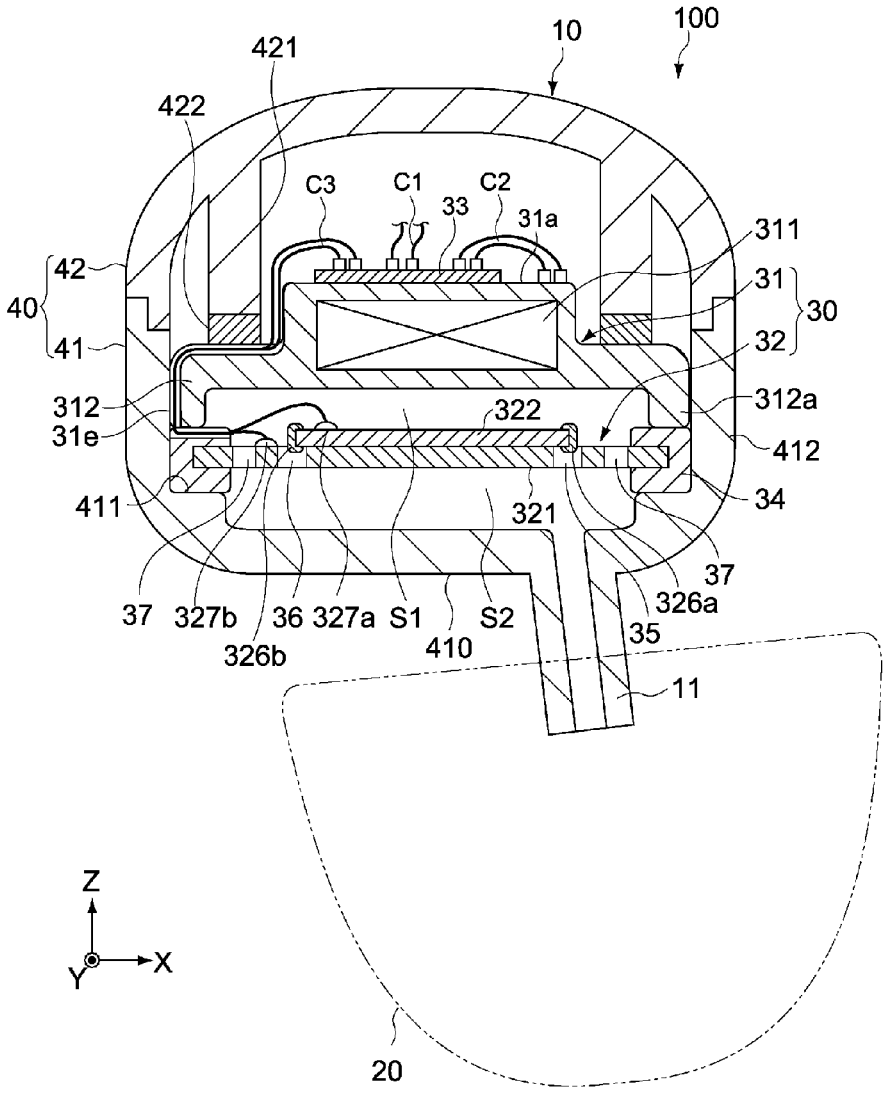

[Fig. 2]
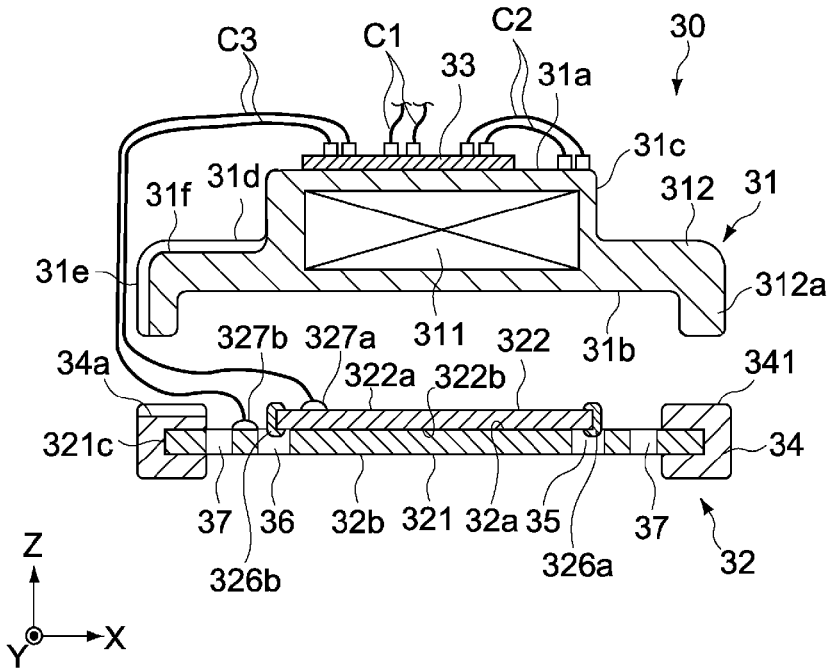
[Fig. 3]
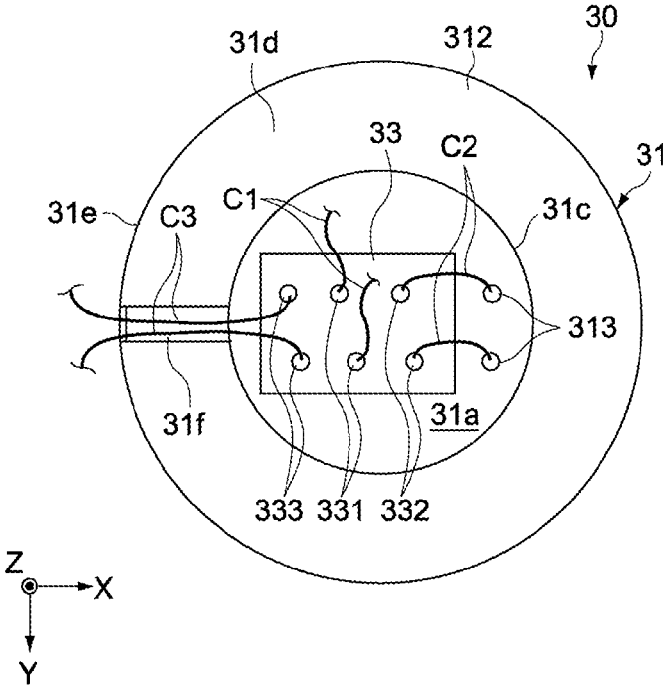

[Fig. 4]
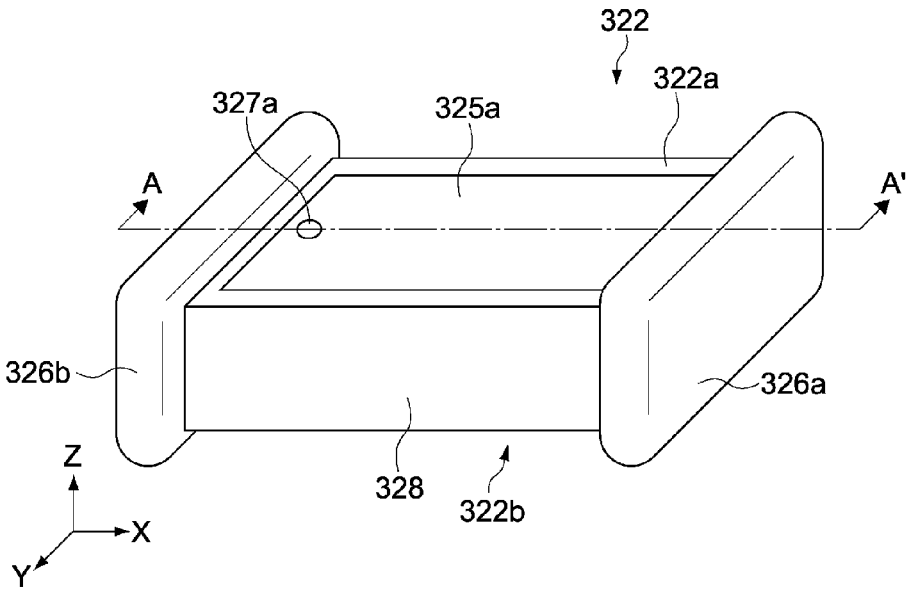
[Fig. 5]
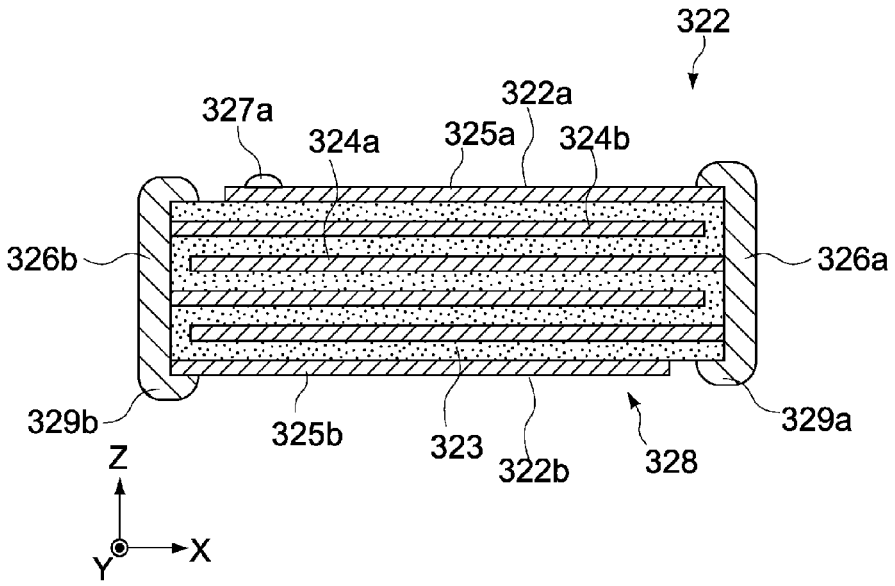

[Fig. 6]
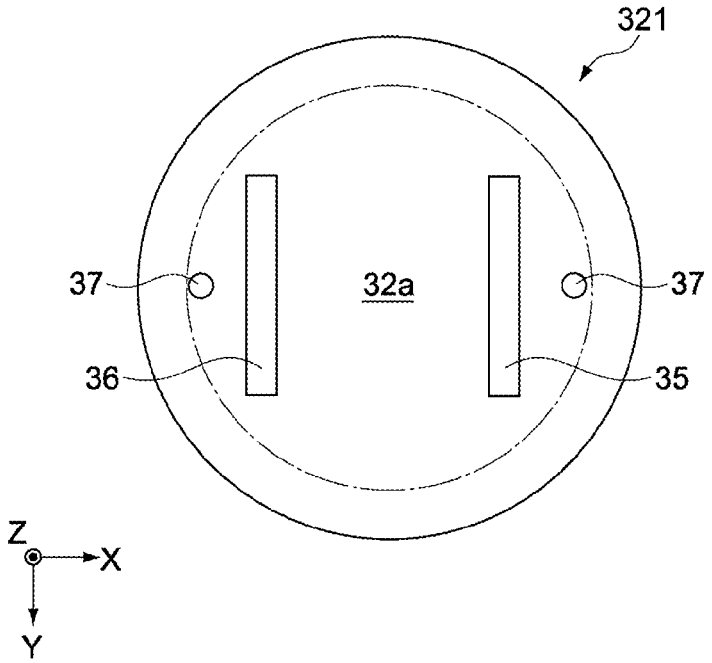
[Fig. 7]
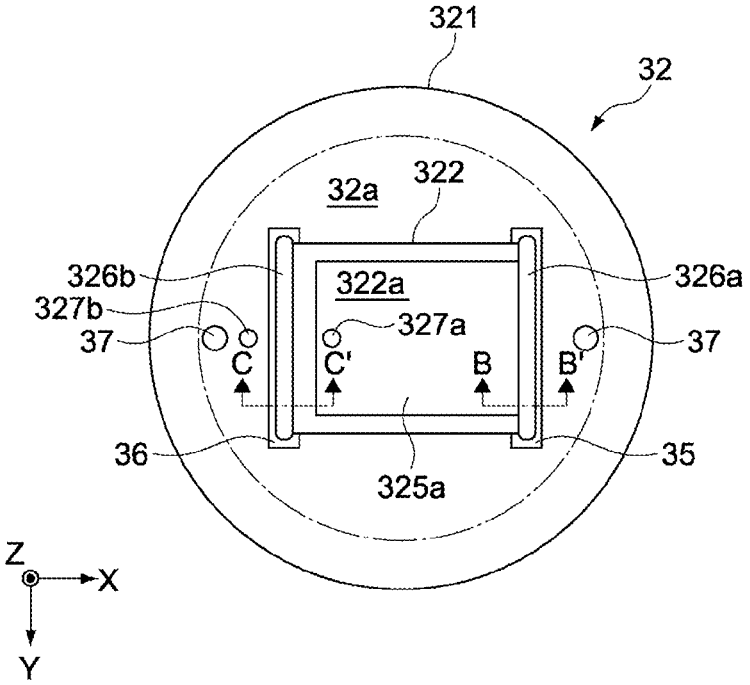

[Fig. 8A]
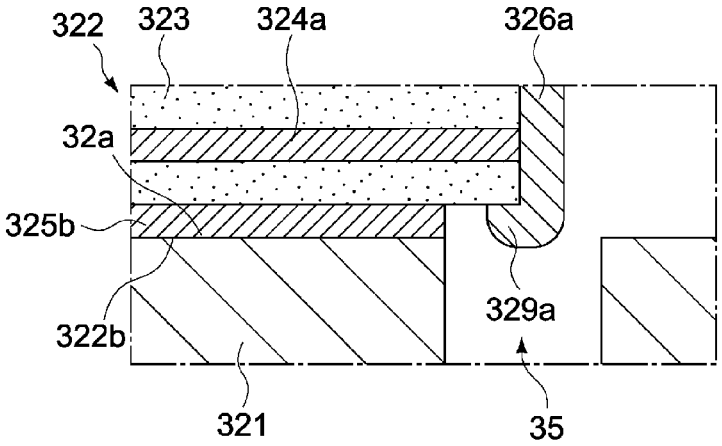
[Fig. 8B]
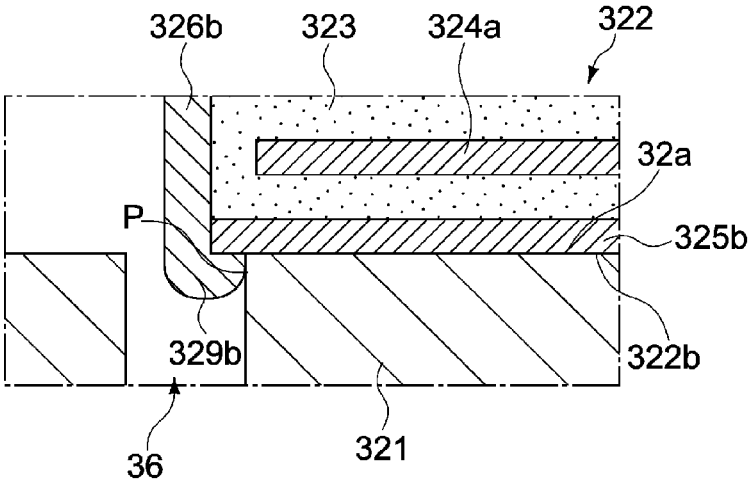
[Fig. 8C]
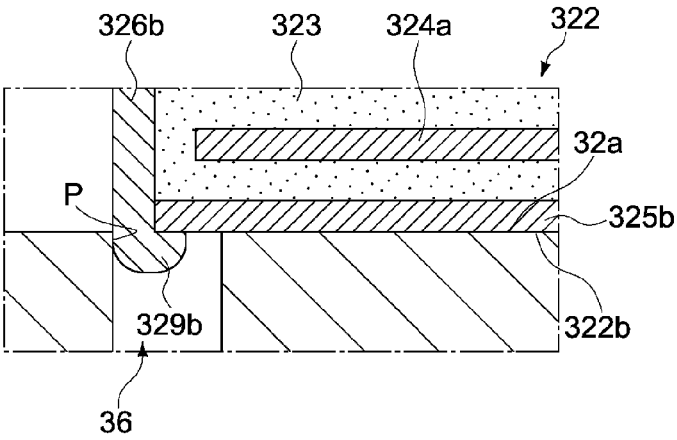

[Fig. 9]
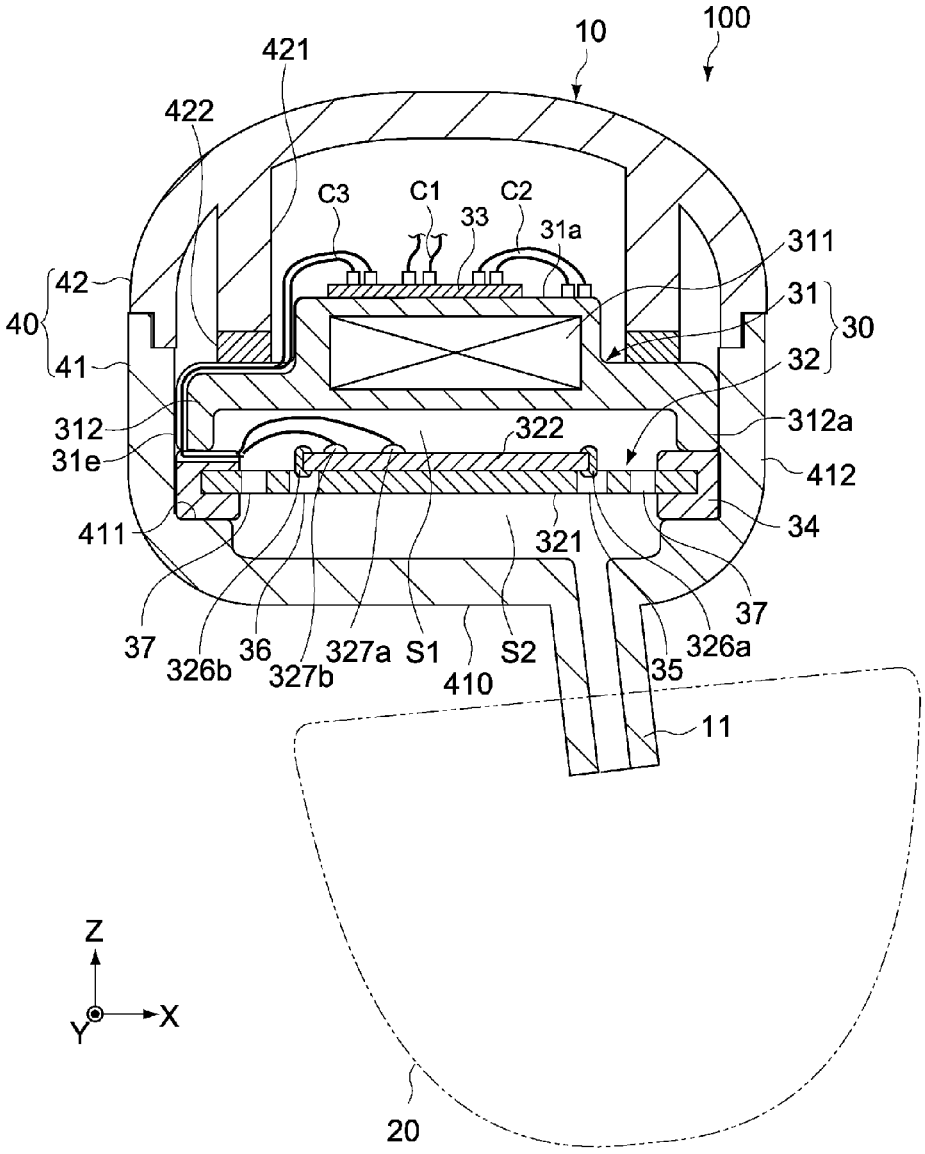

[Fig. 10]
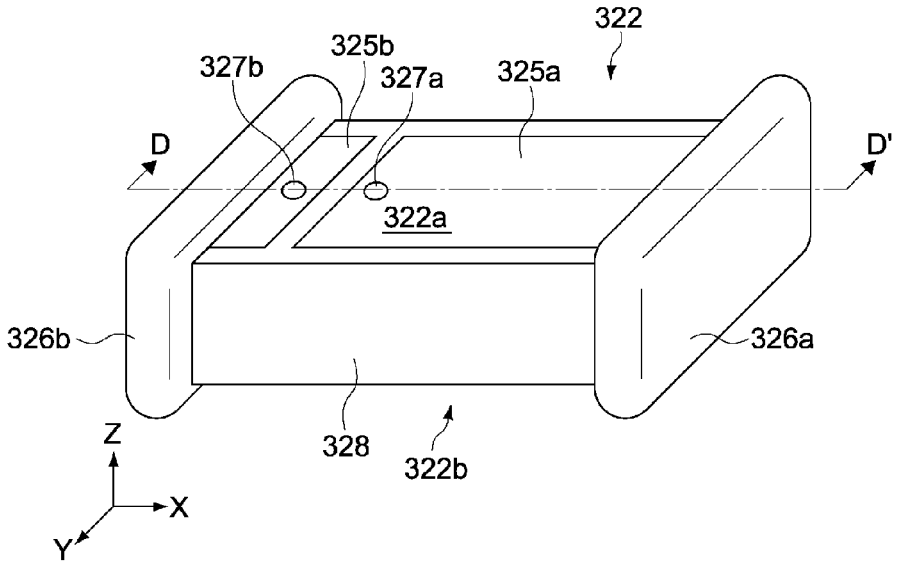
[Fig. 11]
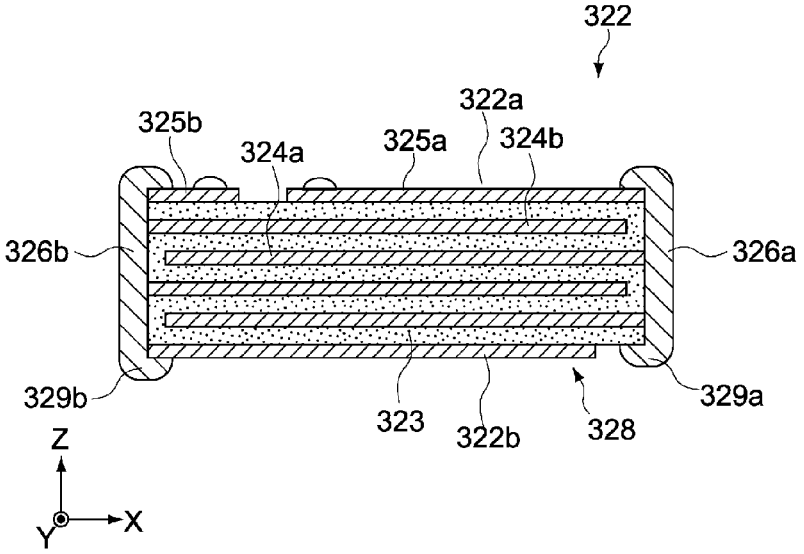

[Fig. 12]
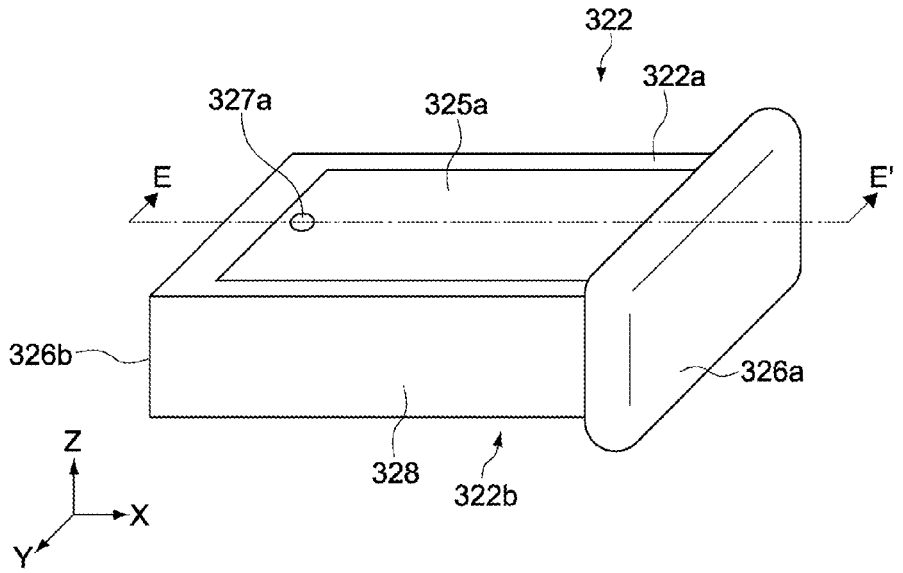
[Fig. 13]
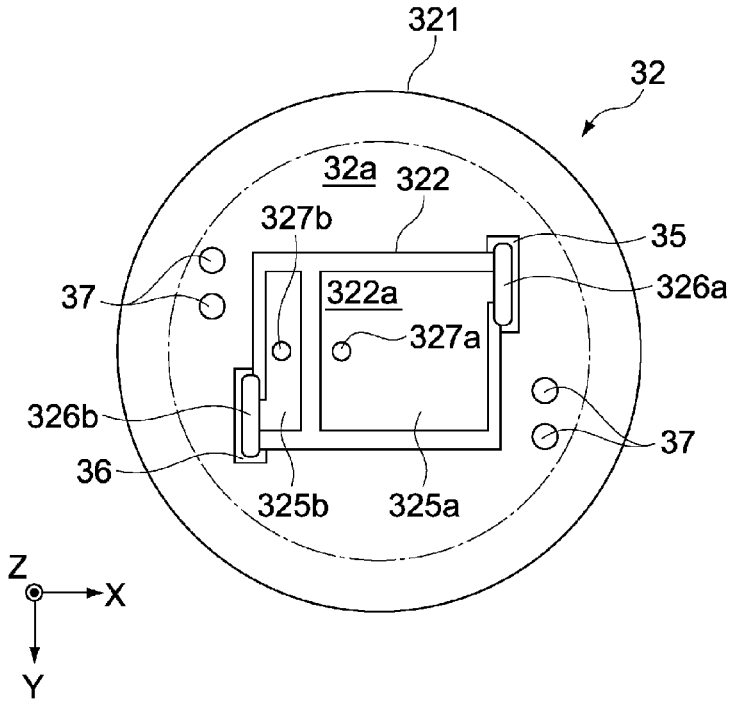

[Fig. 14]
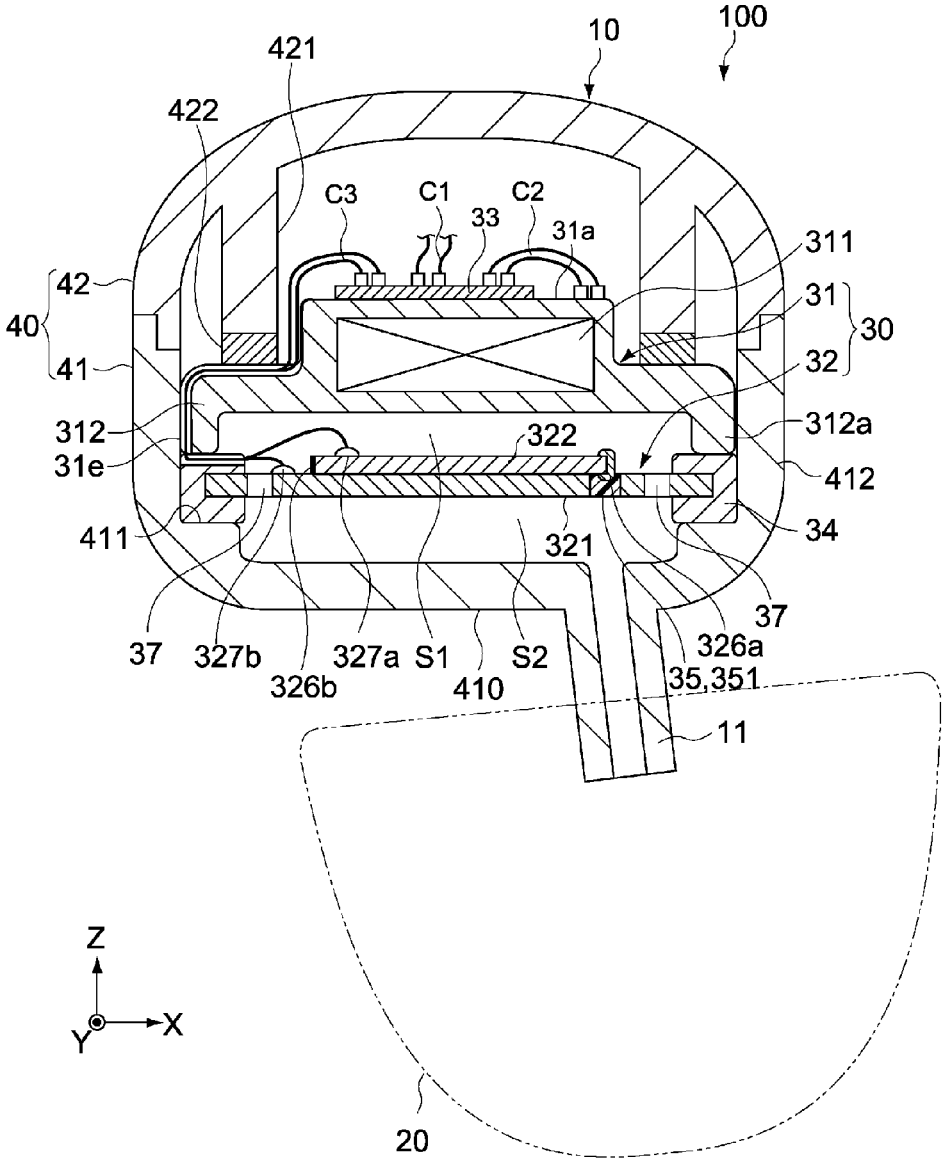

[Fig. 15]
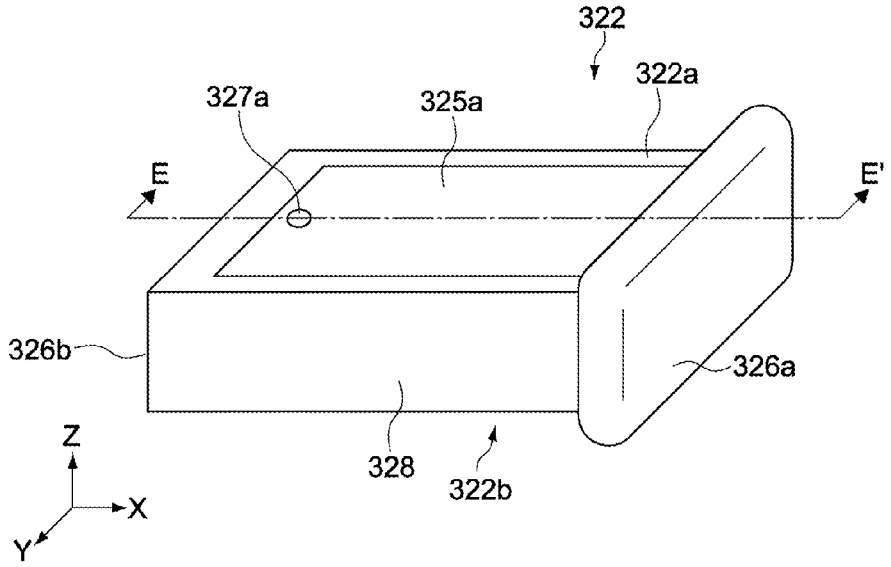
[Fig. 16]
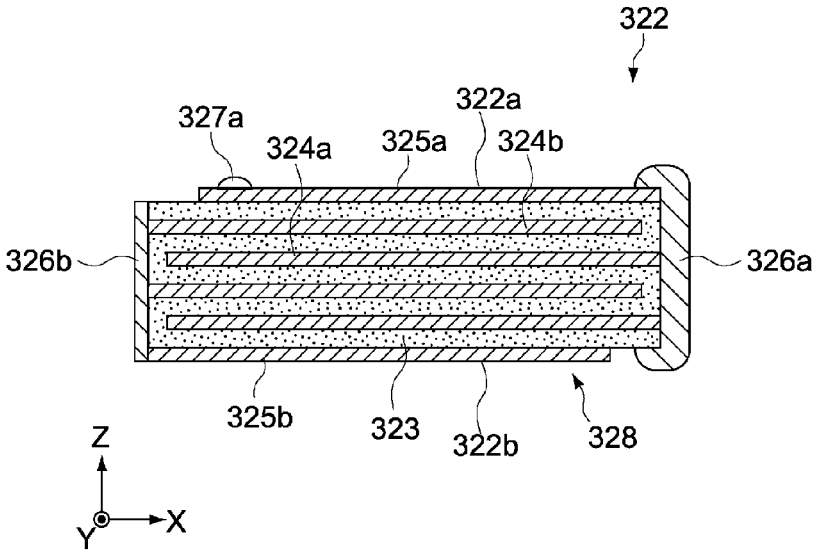

[Fig. 17]
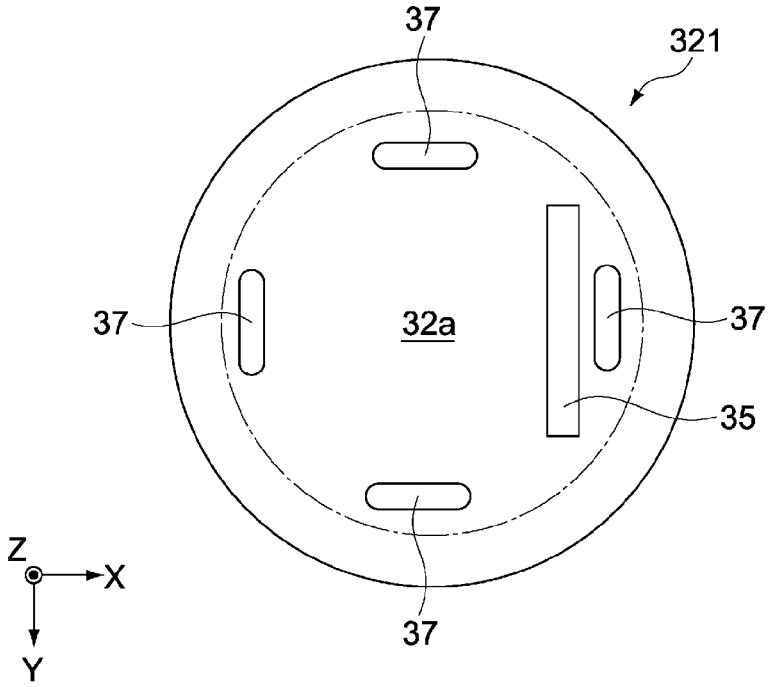
[Fig. 18]
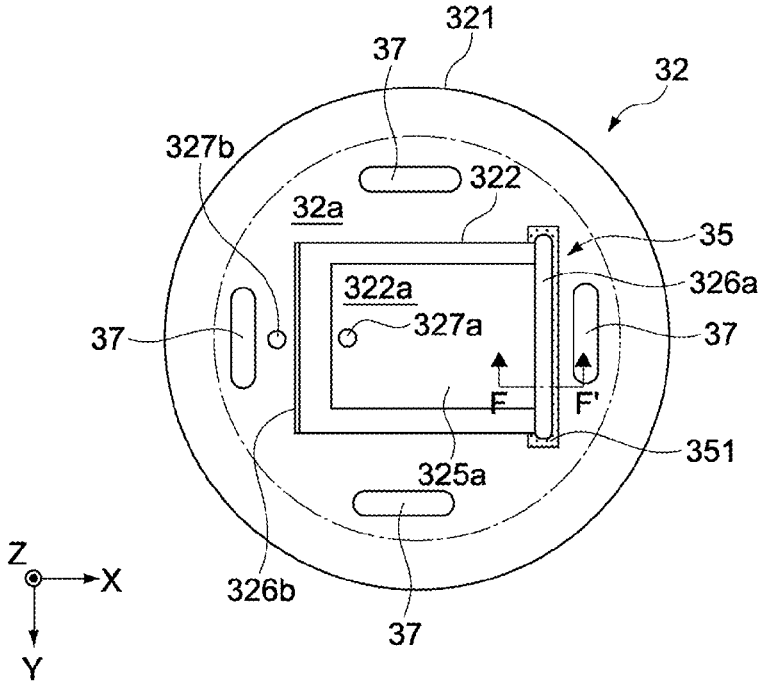

[Fig. 19]
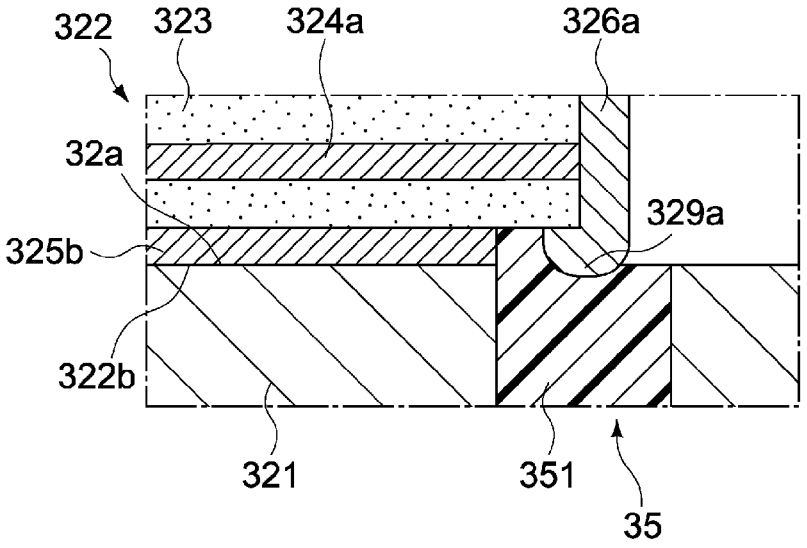
[Fig. 20]
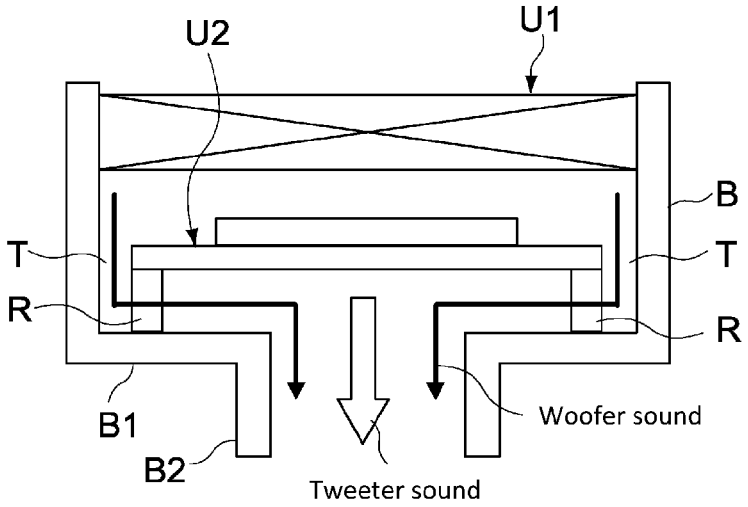

PIEZOELECTRIC SPEAKER AND ELECTROACOUSTIC TRANSDUCER

BACKGROUND

Field of the Invention

The present invention relates to a piezoelectric speaker and electroacoustic transducer that can be applied to earphones, headphones, mobile information terminals, etc., for example.

Description of the Related Art

Piezoelectric speakers are widely used as a simple means for electroacoustic conversion, where popular applications include earphones, headphones and other acoustic devices as well as speakers for mobile information terminals, etc., for example. Patent Literature 1 discloses a piezoelectric speaker constituted by a vibration plate made of metal material and a piezoelectric element joined to it.

A piezoelectric speaker having the above constitution can generate sound waves according to the playback signals input to the two external electrodes of the piezoelectric element, by causing the vibration plate to vibrate based on the playback signals.

[Patent Literature 1] Japanese Patent Laid-open No. 2013-150305

SUMMARY

The dip method is known as a simple method for forming each external electrode of the piezoelectric element. However, external electrodes formed by the dip method protrude from the base body, which means that, once the piezoelectric element is joined to the vibration plate, the two external electrodes may both contact the conductive vibration plate. In this case, the two external electrodes will short to each other via the vibration plate.

In light of the aforementioned situation, an object of the present invention is to provide a piezoelectric speaker and electroacoustic transducer capable of preventing the external electrodes of the piezoelectric element from shorting to each other.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, a piezoelectric speaker pertaining to an embodiment of the present invention has a piezoelectric element and vibration plate.

The piezoelectric element has a base body with a mounting surface, as well as first and second terminals that are formed on the mounting surface with a distance between them.

The vibration plate has a conductive body which is joined to the piezoelectric element and has a principle surface facing the mounting surface, as well as a first hole with or without a bottom which is formed on the principle surface in a region facing the first terminal to form a space between the body and first terminal.

According to this constitution, the first terminal of the piezoelectric element does not continue electrically with the conductive body of the vibration plate, which prevents the first terminal and second terminal of the piezoelectric element from shorting to each other.

Also when the first terminal of the piezoelectric element has a convex part protruding from the mounting surface, the convex part enters the first hole in the vibration plate to allow the mounting surface of the piezoelectric element to make good surface contact with the principle surface of the vibration plate, and therefore the vibration generated by the piezoelectric element is transferred well to the vibration plate. Accordingly, the dip method or other method that generates a convex part can be adopted for forming the first terminal of the piezoelectric element.

The second terminal may have a convex part protruding from the mounting surface.

The vibration plate may further have a second hole with or without a bottom that engages with the convex part.

According to this constitution, the convex part of the second terminal of the piezoelectric element enters the second hole in the vibration plate to allow the mounting surface of the piezoelectric element to make good surface contact with the principle surface of the vibration plate, and therefore the vibration generated by the piezoelectric element is transferred to the vibration plate in a favorable manner. Accordingly, the dip method or other method that generates a convex part can be adopted for forming the second terminal of the piezoelectric element.

The second hole may have a regulation part that regulates the relative position of the convex part with respect to the body.

According to this constitution, the relative position of the convex part of the second terminal of the piezoelectric element is regulated by the regulation part of the second hole in the vibration plate, which allows the relative position of the vibration plate and piezoelectric element to be adjusted simply and accurately.

The first hole and second hole may be formed at positions that are line-symmetrical or point-symmetrical to each other.

According to this constitution, the vibration plate vibrates more isotropically, to allow the vibration plate to generate better sound waves.

The vibration plate may further have a single or multiple third holes penetrating the plate in its thickness direction.

According to this constitution, sound waves generated by a speaker other than the piezoelectric speaker can pass through the third hole(s). As a result, the electroacoustic transducer that contains the piezoelectric speaker and other speaker can generate better acoustics.

The principle surface is circular and the mounting surface may have a polygonal shape.

According to this constitution a space in which to provide the third hole is secured on the vibration plate at least adjacent to each side of the mounting surface of the piezoelectric element. As a result, this constitution does not require making the piezoelectric element smaller to provide the third hole(s), which guarantees the function of the piezoelectric element in a more favorable manner.

The first hole may be filled with insulating resin.

According to this constitution, the first terminal of the piezoelectric element is more reliably insulated from the body of the vibration plate by the insulating resin.

An electroacoustic transducer pertaining to an embodiment of the present invention has a housing, piezoelectric element, vibration plate, and dynamic speaker.

The piezoelectric element has a base body with a mounting surface, as well as first and second terminals that are formed on the mounting surface with a distance between them.

The vibration plate has a conductive body supported by the housing, joined to the piezoelectric element, and having a principle surface facing the mounting surface, as well as a through hole which is formed on the principle surface in a region facing the first terminal to form a space between the body and first terminal.

The dynamic speaker is housed in the housing and placed in a manner facing the vibration plate.

The through hole may be constituted as a sound-passing part through which the sound waves generated by the dynamic speaker pass.

According to this constitution, the sound waves generated by the dynamic speaker can pass through the through hole in the vibration plate, which allows for generation of better acoustics by the electroacoustic transducer having the piezoelectric speaker constituted by the piezoelectric element and vibration plate, as well as the dynamic speaker.

A piezoelectric speaker and electroacoustic transducer capable of preventing the external electrodes of the piezoelectric element from shorting to each other can be provided.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a lateral section view showing a rough constitution of an electroacoustic transducer pertaining to the first embodiment of the present invention.

FIG. 2 is a lateral exploded section view showing a rough constitution of the dynamic speaker and piezoelectric speaker of the electroacoustic transducer.

FIG. 3 is a plan view showing a rough constitution of the electroacoustic transducer.

FIG. 4 is a perspective view showing a rough constitution of the piezoelectric element of the electroacoustic transducer.

FIG. 5 is a section view of FIG. 4 of the piezoelectric element, cut along line A-A'.

FIG. 6 is a plan view showing a rough constitution of the vibration plate of the electroacoustic transducer.

FIG. 7 is a plan view showing a rough constitution of the piezoelectric speaker of the electroacoustic transducer.

FIG. 8A is a partial section view of FIG. 7 of the piezoelectric speaker, cut along line B-B'.

FIG. 8B is a partial section view of FIG. 7 of the piezoelectric speaker, cut along line C-C'.

FIG. 8C is a partial section view of FIG. 7 of the piezoelectric speaker, cut along line C-C'.

FIG. 9 is a lateral section view showing a rough constitution of the electroacoustic transducer pertaining to Variation Example 1 of the first embodiment.

FIG. 10 is a perspective view showing a rough constitution of the piezoelectric element of the electroacoustic transducer pertaining to Variation Example 1.

FIG. 11 is a section view of FIG. 10 of the piezoelectric element pertaining to Variation Example 1, cut along line D-D'.

FIG. 12 is a perspective view showing a rough constitution of the piezoelectric element of the electroacoustic transducer pertaining to Variation Example 2 of the first embodiment.

FIG. 13 is a plan view showing a rough constitution of the electroacoustic transducer pertaining to Variation Example 2.

FIG. 14 is a lateral section view showing a rough constitution of the electroacoustic transducer pertaining to the second embodiment of the present invention.

FIG. 15 is a perspective view showing a rough constitution of the piezoelectric element of the electroacoustic transducer.

FIG. 16 is a section view of FIG. 15 of the piezoelectric element, cut along line E-E'.

FIG. 17 is a plan view showing a rough constitution of the vibration plate of the electroacoustic transducer.

FIG. 18 is a plan view showing a rough constitution of the piezoelectric speaker of the electroacoustic transducer.

FIG. 19 is a partial section view of FIG. 18 of the piezoelectric speaker, cut along line F-F'.

FIG. 20 is a schematic view showing a constitutional variation example of the electroacoustic transducer pertaining to an embodiment of the present invention.

DESCRIPTION OF THE SYMBOLS

100 - - - Earphone
30 - - - Sounding unit
31 - - - Dynamic speaker
32 - - - Piezoelectric speaker
321 - - - Vibration plate
32*a* - - - First principle surface
32*b* - - - Second principle surface
322 - - - Piezoelectric element
322*a* - - - First principle surface
322*b* - - - Second principle surface
326*a* - - - First external electrode
326*b* - - - Second external electrode
328 - - - Base body
325*a* - - - First leader electrode layer
325*b* - - - Second leader electrode layer
35 - - - First hole
36 - - - Second hole
37 - - - Third hole

DETAILED DESCRIPTION OF EMBODIMENTS

First Embodiment

FIG. 1 is a lateral section view showing a rough constitution of an earphone 100 as an electroacoustic transducer pertaining to the first embodiment of the present invention.

The figure shows the X-axis, Y-axis, and Z-axis crossing at right angles to one another as deemed appropriate. The X-axis, Y-axis, and Z-axis are common in all figures.

[Overall Constitution of Earphone]

The earphone 100 pertaining to this embodiment has an earphone body 10 and earpiece 20. The earpiece 20 is attached to a sound path 11 of the earphone body 10, while constituted in such a way that it can be worn on the user's ear.

The earphone body 10 has a sounding unit 30, and an enclosure 40 that houses the sounding unit 30. The sounding unit 30 has a dynamic speaker 31 and piezoelectric speaker 32. The enclosure 40 has a housing 41 and cover 42.

[Housing]

The housing 41 has the shape of a cylinder with a bottom and is typically constituted by injection-molded plastics. The housing 41 has an interior space in which the sounding unit 30 is housed, and at its bottom 410 the sound path 11 is provided that connects to the interior space.

The housing 41 has a support 411 that supports the periphery of the piezoelectric speaker 32, and a side wall 412 enclosing the sounding unit 30 all around. The support 411 and side wall 412 are both formed in a ring shape, where the support 411 is provided in such a way that it projects inward from near the bottom of the side wall 412. The support 411 is formed by a plane running in parallel with the XY plane, and supports the periphery of the piezoelectric speaker 32 either directly or indirectly via another member. It should be noted that the support 411 may be constituted by multiple pillars placed in a ring pattern along the inner periphery surface of the side wall 412.

[Dynamic Speaker]

The dynamic speaker 31 is constituted by a speaker unit that functions as a woofer to play back low-pitch sounds. The dynamic speaker 31 is constituted by a dynamic speaker that primarily generates sound waves of 7 kHz or below, for example, and has a mechanism 311 containing a voice coil motor (electromagnetic coil) or other vibration body, and a base 312 that vibratively supports the mechanism 311. The base 312 is formed roughly in a disk shape whose outer diameter is roughly identical to the inner diameter of the side wall 412 of the housing 41, and has a periphery surface 31*e* that engages with the side wall 412.

FIG. 2 is a lateral exploded section view of the sounding unit 30 in a state not yet assembled into the housing 41, while FIG. 3 is a plan view showing a rough constitution of the sounding unit 30.

The dynamic speaker 31 is formed in a disk shape having a first surface 31*a* facing the opposite side of the piezoelectric speaker 32 and a second surface 31*b* facing the piezoelectric speaker 32. Provided along the periphery of the second surface 31*b* is a leg 312*a* contactively facing the periphery of the piezoelectric speaker 32. The leg 312*a* is formed in a ring shape, but it is not limited to the foregoing and may be constituted by multiple pillars.

The first surface 31*a* is formed on the surface of a disk-shaped projection 31*c* provided at the center of the top surface of the base 312. The first surface 31*a* has a circuit board 33 fixed to it that constitutes the electrical circuit of the sounding unit 30. Provided on the surface of the circuit board 33 are multiple terminals 331, 332, 333 that connect to various wiring members, as shown in FIG. 3. The circuit board 33 is typically constituted by a wiring board, but any board can be used so long as it has terminals that connect to various wiring members. Also, the location of the circuit board 33 is not limited to the first surface 31*a* as in the example, and it can be provided elsewhere such as on the interior wall of the cover 42, for example.

The terminals 331, 332, 333 are each provided as a pair. The terminal 331 connects to a wiring member C1 that inputs playback signals sent from a playback device not illustrated here. The terminal 332 connects electrically to an input terminal 313 of the dynamic speaker 31 via a wiring member C2. The terminal 333 connects electrically to input terminals 327*a*, 327*b* of the piezoelectric speaker 32 via a wiring member C3. It should be noted that the wiring members C2, C3 may be connected directly to the wiring member C1 without going through the circuit board 33.

[Piezoelectric Speaker]

(Overall Constitution)

The piezoelectric speaker 32 constitutes a speaker unit that functions as a tweeter to play back high-pitch sounds. In this embodiment, its oscillation frequency is set in such a way to primarily generate sound waves of 7 kHz or above, for example. The piezoelectric speaker 32 has a vibration plate 321 and piezoelectric element 322.

The vibration plate 321 is constituted by metal (such as 42 alloy) or other conductive material, and its plane shape is formed circular. The outer diameter and thickness of the vibration plate 321 are not limited in any way, and can be set as deemed appropriate according to the size of the housing 41, frequency band of playback sound waves, and so on. The outer diameter of the vibration plate 321 is set smaller than the outer diameter of the dynamic speaker 31, and the shape of the vibration plate 321 may be approx. 12 mm in diameter and approx. 0.2 mm in thickness, for example.

The vibration plate 321 can have a concave shape sinking in from its outer periphery toward the inner periphery, or cutouts formed as slits, etc. It should be noted that even when the planar shape of the vibration plate 321 is not strictly circular due to formation of the cutouts, etc., it is still considered "circular" so long as the shape is roughly circular.

As shown in FIG. 2, the vibration plate 321 has a periphery 321*c* supported by the housing 41.

The sounding unit 30 further has a ring-shaped member 34 placed between the support 411 of the housing 41 and the periphery 321*c* of the vibration plate 321. The ring-shaped member 34 has a support surface 341 that supports the leg 312*a* of the dynamic speaker 31. The outer diameter of the ring-shaped member 34 is formed roughly identical to the inner diameter of the side wall 412 of the housing 41.

The material constituting the ring-shaped member 34 is not limited in any way, and it may be constituted by metal material, synthetic resin material, or rubber or other elastic material, for example. If the ring-shaped member 34 is constituted by rubber or other elastic material, resonance wobble of the vibration plate 321 is suppressed and therefore stable resonance action of the vibration plate 321 can be ensured.

The vibration plate 321 has a first principle surface 32*a* facing the dynamic speaker 31, and a second principle surface 32*b* facing the sound path 11. In this embodiment, the piezoelectric speaker 32 has a unimorph structure where the piezoelectric element 322 is joined only to the first principle surface 32*a* of the vibration plate 321.

In addition to the above, the piezoelectric element 322 may be joined to the second principle surface 32*b* of the vibration plate 321. Also, the piezoelectric speaker 32 may be constituted by a bimorph structure where the piezoelectric element 322 is joined to both of the principle surfaces 32*a*, 32*b* of the vibration plate 321, respectively.

(Piezoelectric Element)

FIG. 4 is a perspective view showing a rough constitution of the piezoelectric element 322, while FIG. 5 is a section view of the piezoelectric element 322 in FIG. 4, cut along line A-A'.

The piezoelectric element 322 has a base body 328, as well as a first electrode 326*a* and second electrode 326*b* provided on the base body 328 and facing each other in the X-axis direction. Also, the piezoelectric element 322 has a first principle surface 322*a* and second principle surface 322*b* facing each other and vertical to the Z-axis.

The second principle surface 322*b* of the piezoelectric element 322 is constituted as a mounting surface facing the first principle surface 32*a* of the vibration plate 321.

The planar shape of the piezoelectric element 322 (shape of the principle surfaces 322*a*, 322*b*) is formed rectangular (oblong figure) in this embodiment, but the shape can be a square, parallelogram, trapezoid or other quadrangle, or any polygon other than quadrangle, or circle, oval, ellipsoid, etc. The thickness of the piezoelectric element 322 is not limited in any way, either, and can be approx. 50 μm, for example.

The base body 328 has a structure of ceramic sheets 323 and internal electrode layers 324*a*, 324*b* stacked together in the Z-axis direction. To be specific, the internal electrode layers 324*a*, 324*b* are stacked together in a manner alternating with the ceramic sheets 323, with a ceramic sheet sandwiched between each pair of internal electrode layers. The ceramic sheet 323 is formed by lead zirconate titanate (PZT), alkali metal-containing niobium oxide, or other piezoelectric material, for example. The internal electrode layers 324*a*, 324*b* are formed by any of various metal materials and other conductive materials.

The external electrodes 326*a*, 326*b* are formed by any of various metal materials and other conductive materials on both ends of the base body 328 in the X-axis direction. In this embodiment, the simple dip method is adopted for forming the external electrodes 326*a*, 326*b*. The external electrodes 326*a*, 326*b* formed by the dip method protrude from the four sides of the base body 328, respectively, as shown in FIG. 4. It should be noted that the protrusion of the external electrodes 326*a*, 326*b* is exaggerated in the figure for the convenience of illustration.

The method for forming the external electrodes 326*a*, 326*b* is not limited to any specific method, and the application method, sputtering method, or any other method different from the dip method may be used. Furthermore, the method for forming the first external electrode 326*a* may be different from the method for forming the second external electrode 326*b*. The constitution of this embodiment is particularly effective when at least one of the external electrodes 326*a*, 326*b* protrudes from the second principle surface 322*b* on the piezoelectric element 322, the details of which are described later.

The first internal electrode layer 324*a* of the base body 328 is connected to the first external electrode 326*a*, while being insulated from the second external electrode 326*b* by a margin part of the ceramic sheet 323. Also, the second internal electrode layer 324*b* of the base body 328 is connected to the second external electrode 326*b*, while being insulated from the first external electrode 326*a* by a margin part of the ceramic sheet 323.

According to this constitution, each ceramic sheet 323 present between each pair of internal electrode layers 324*a*, 324*b* expands and contracts at a specified frequency when alternating current voltage is applied between the external electrodes 326*a*, 326*b*. This allows the piezoelectric element 322 to generate the vibration to be transmitted to the vibration plate 321.

(Electrical Connection Constitution of Piezoelectric Speaker)

The following explains the constitution of the piezoelectric speaker 32 to connect each wiring member C3 that has been led out from the circuit board 33, to each external electrode 326*a* or 326*b* of the piezoelectric element 322.

As described above, the input terminals 327*a*, 327*b* to be connected to the wiring members C3 are provided on the piezoelectric speaker 32. On the piezoelectric speaker 32, the first input terminal 327*a* is connected to the first external electrode 326*a*, while the second input terminal 327*b* is connected to the second external electrode 326*b*.

To connect the first input terminal 327*a* and first external electrode 326*a*, a first leader electrode layer 325*a* that has been led out from the first external electrode 326*a* is provided on the first principle surface 322*a* of the piezoelectric element 322. Also, to connect the second input terminal 327*b* and second external electrode 326*b*, a second leader electrode layer 325*b* that has been led out from the second external electrode 326*b* is provided on the second principle surface 322*b* of the piezoelectric element 322. The first leader electrode layer 325*a* is away from the second external electrode 326*b*, while the second leader electrode layer 325*b* is away from the first external electrode 326*a*.

As shown in FIG. 2, the second principle surface 322*b* of the piezoelectric element 322 is joined to the first principle surface 32*a* facing the vibration plate 321. This causes the second leader electrode layer 325*b* to electrically continue to the vibration plate 321. Conductive adhesive or solder may be used to join the piezoelectric element 322 and vibration plate 321, or insulating adhesive may also be used if contact between the second leader electrode layer 325*b* and vibration plate 321 can be ensured. The piezoelectric speaker 32 is constituted in such a way that the first external electrode 326*a* does not electrically continue to the vibration plate 321, the details of which are described later.

The first input terminal 327*a* is directly provided on the first leader electrode layer 325*a*. The second input terminal 327*b* is provided on the first principle surface 32*a* of the vibration plate 321, and connected to the second leader electrode layer 325*b* via the conductive body of the vibration plate 321. In other words, the input terminals 327*a*, 327*b* that receive playback signals via the wiring members C3 are connected to the external electrodes 326*a*, 326*b* via the leader electrode layers 325*a*, 325*b*, respectively.

According to this constitution, the piezoelectric speaker 32 can generate sound waves based on the playback signals that have been input to the input terminals 327*a*, 327*b* from the circuit board 33 via the wiring members C3.

(Holes in Vibration Plate)

FIG. 6 is a plan view showing a rough constitution of the vibration plate 321, while FIG. 7 is a plan view showing a rough constitution of the piezoelectric speaker 32 constituted by the piezoelectric element 322 joined to this vibration plate 321.

The conductive body of the vibration plate 321 has a first hole 35 and second hole 36 formed in it. While the first hole 35 and second hole 36 are constituted as through holes without bottom in this embodiment, they may be constituted as concave parts with bottoms.

The first hole 35 is formed in a region facing the first external electrode 326*a* of the piezoelectric element 322, and in the shape of a rectangle larger than the outer shape of the first external electrode 326*a* in the X-axis direction and Y-axis direction. In other words, the first external electrode 326*a* is housed inside the first hole 35 in the X-axis direction and Y-axis direction. The first external electrode 326*a* is placed in the center region of the first hole 35.

FIG. 8A is a partial section view of the piezoelectric speaker 32 in FIG. 7, cut along line B-B'. The first external electrode 326*a* has a first convex part 329*a* protruding downward in the Z-axis direction, and the first convex part 329*a* protrudes beyond the plane of the second principle surface 322*b* of the piezoelectric element 322. The first convex part 329*a* of the first external electrode 326*a* enters the first hole 35 from the first principle surface 32*a* of the vibration plate 321.

As described above, the formation of the first hole 35 in the vibration plate 321 prevents the first convex part 329*a* of the first external electrode 326*a*, although protruding beyond the plane of the second principle surface 322*b* of the piezoelectric element 322, from interfering with the second principle surface 322*b* of the piezoelectric element 322 making surface contact with the first principle surface 32*a* of the vibration plate 321.

Also, the first hole 35 in the vibration plate 321 allows a space to be formed between the first external electrode 326*a* and the body of the vibration plate 321. This way, the first external electrode 326*a* is insulated from the body of the vibration plate 321.

As described above, the external electrode 326*a* serving as the first terminal to be connected to the first input terminal 327*a* is insulated from the body of the vibration plate 321. Accordingly, the first input terminal 327*a* and second input terminal 327*b* are not shorted to each other via the vibration plate 321, even in a constitution where the second leader electrode layer 325*b* and second external electrode 326*b* serving as the second terminal to be connected to the second input terminal 327*b* continue electrically to the vibration plate 321.

It should be noted that, even when the first external electrode 326*a* is formed by the application method, sputtering method, or any other method different from the dip method, and therefore the first convex part 329*a* shown in FIG. 8A is not produced on the external electrode 326*a*, the constitution of the first hole 35 in the vibration plate 321 is still effective. To be specific, the first hole 35 makes the body of the vibration plate 321 no longer present directly under the external electrode 326*a*, and thus the external electrode 326*a* can be more reliably insulated from the body of the vibration plate 321.

The second hole 36 is formed in a region facing the second external electrode 326*b* of the piezoelectric element 322, and in the shape of a rectangle larger than the outer shape of the second external electrode 326*b* in the X-axis direction and Y-axis direction. In other words, the second external electrode 326*b* is housed inside the second hole 36 in the X-axis direction and Y-axis direction.

FIG. 8B is a partial section view of the piezoelectric speaker 32 in FIG. 7, cut along line C-C'. The second external electrode 326*b* has a second convex part 329*b* protruding downward in the Z-axis direction, and the second convex part 329*b* protrudes beyond the plane of the second principle surface 322*b* of the piezoelectric element 322. The second convex part 329*b* of the second external electrode 326*b* enters the second hole 36 from the first principle surface 32*a* of the vibration plate 321.

As described above, the formation of the second hole 36 in the vibration plate 321 prevents the second convex part 329*b* of the second external electrode 326*b*, although protruding beyond the plane of the second principle surface 322*b* of the piezoelectric element 322, from interfering with the second principle surface 322*b* of the piezoelectric element 322 making surface contact with the first principle surface 32*a* of the vibration plate 321.

The second convex part 329*b* of the second external electrode 326*b* contacts the regulation part P on the interior side of the interior wall of the second hole 36. In the manufacturing process of the piezoelectric speaker 32, moving the convex part 329*b* of the second external electrode 326*b* until it stops upon contacting the regulation part P of the second hole 36 allows the first external electrode 326*a* to be positioned as shown in FIG. 8A when joining the piezoelectric element 322 to the vibration plate 321. As described above, with the piezoelectric speaker 32 the relative positions of the vibration plate 321 and piezoelectric element 322 can be adjusted simply and accurately.

It should be noted that the regulation part P of the second hole 36 is not limited to the constitution shown in FIG. 8B where it is located on the interior side of the interior wall of the second hole 36; instead, it may be located on the exterior side of the interior wall of the second hole 36, as shown in FIG. 8C. Furthermore, in a constitution where the relative positions of the vibration plate 321 and piezoelectric element 322 can be adjusted by other methods, the regulation part P need not be provided in the second hole 36. In other words, the second external electrode 326*b* may be away from the body of the vibration plate 321.

The positions and shapes of the first hole 35 and second hole 36 may be determined as deemed appropriate according to the positions and shapes of the external electrodes 326*a*, 326*b* of the piezoelectric element 322, or the like. For example, the first hole 35 and second hole 36 may be formed in such a way that their short sides are circular, oval or otherwise curved.

However, preferably the first hole 35 and second hole 36 are formed in such a way that they become symmetrical to each other. To be more specific, preferably the first hole 35 and second hole 36 are formed in such a way that they are point-symmetrical to each other across the center point of the vibration plate 321, or line-symmetrical to each other across the center line passing through the center point of the vibration plate 321. This way, the vibration plate 321 vibrates more isotropically, to allow the vibration plate 321 to generate better sound waves.

(Sound-Passing Part of Vibration Plate)

As shown in FIG. 1, the vibration plate 321 separates a first space S1 where the dynamic speaker 31 is placed, and a second space S2 where the sound path 11 is provided. Accordingly, when the first space S1 is closed in an air-tight manner, low-pitch sound waves may not be generated with desired frequency characteristics. To be specific, it is difficult to flexibly cope with the peak level adjustment in a specific frequency band, or the optimization of frequency characteristics at the cross point between the low-pitch sound characteristic curve and high-pitch sound characteristic curve, or the like.

Accordingly, preferably the holes 35, 36 are constituted as through holes without bottom and sufficiently large margin parts are ensured on the outer side of the external electrodes 326*a*, 326*b*. In this case, the holes 35, 36 function as sound-passing parts through which the sound waves generated by the dynamic speaker 31 in the first space S1 are passed to the second space S2. As a result, the sound waves generated by the dynamic speaker 31 are released in a favorable manner from the sound path 11.

Furthermore, the vibration plate 321 has third holes 37 formed in it, which penetrate the plate in its thickness direction.

The third holes 37 are constituted as round holes that are formed on the outer side of and adjacent to the holes 35, 36, and function as sound-passing parts through which the sound waves generated by the dynamic speaker 31 are passed to the second space S2 in a more favorable manner.

Accordingly, the third holes 37 need not be provided if the sound waves generated by the dynamic speaker 31 can be sufficiently passed to the second space S2 using only the holes 35, 36. It should be noted that, while the third holes 37 are not limited to any specific constitution (number, position, shape, etc.), preferably they are formed in such a way that they become symmetrical to each other, as with the holes 35, 36.

From the viewpoint of providing the third holes 37 in the vibration plate 321, preferably the planar shape of the piezoelectric element 322 (shape of the principle surfaces 322*a*, 322*b*) is not circular like the planar shape of the vibration plate 321 (shape of the principle surfaces 32*a*, 32*b*), but it is polygonal such as a rectangle. This way, a space in which to provide the third hole 37 is ensured on the vibration plate 321 at positions at least adjacent to each side of the piezoelectric element 322. As a result, this constitution does not require making the piezoelectric element 322 smaller to provide the third holes 37 in the vibration plate 321, which guarantees the function of the piezoelectric element in a more favorable manner.

Additionally with the earphone 100 pertaining to this embodiment, the low-pitch sound frequency characteristics can be adjusted or tuned according to the constitution of the holes 35, 36, 37 in the vibration plate 321 (such as the sizes of the holes 35, 36, 37 and the number of third holes 37). In other words, the constitution of the holes 35, 36, 37 can be determined according to the desired low-pitch sound frequency characteristics.

[Cover]

The cover 42 is fixed to the top edge of the side wall 412 so as to block off the interior of the housing 41. The interior top surface of the cover 42 has a pressure part 421 that presses the dynamic speaker 31 toward the ring-shaped member 34. This way, the ring-shaped member 34 is sandwiched strongly between the leg 312*a* of the dynamic speaker 31 and the support 411 of the housing 41, to allow the periphery 321*c* of the vibration plate 321 to be connected integrally to the housing 41.

The pressure part 421 of the cover 42 is formed as a ring, and its annular end surface contacts a ring-shaped top surface 31*d* (refer to FIG. 2 and FIG. 3) formed around the projection 31*c* of the dynamic speaker 31 via an elastic layer 422. This way, the dynamic speaker 31 is pressed with a uniform force by the entire circumference of the ring-shaped member 34, thus making it possible to position the sounding unit 30 properly inside the housing 41. It should be noted that the formation of the pressure part 421 is not limited to a ring shape, and it may be constituted by multiple pillars.

A feedthrough is provided at a specified position of the cover 42, in order to lead the wiring member C1 connected to the terminal 331 of the circuit board 33 to a playback device not illustrated here.

[Leader Structure for Wiring Member C3]

The constitution of this embodiment is such that each wiring member C3 connected to the piezoelectric speaker 32 is led out from the first principle surface 32*a* side of the vibration plate 321. In other words, the input terminals 327*a*, 327*b* of the piezoelectric speaker 32 are placed facing the first space S1, which means a wiring path is needed to lead these wiring members C3 to the terminal 333 on the circuit board 33. Accordingly in this embodiment, a guide groove that can house each wiring member C3 is provided on the side periphery surface of the base 312 of the dynamic speaker 31 and also on the ring-shaped member 34.

As shown in FIG. 2, a first guide groove 31*f* to house the multiple wiring members C3 wired between the first surface 31*a* and second surface 31*b* is provided on the periphery surface 31*e* and top surface 31*d* of the dynamic speaker 31. This way, the wiring members C3 can be wired easily without risking damage between the periphery surface 31*e* of the dynamic speaker 31 and the side wall 412 of the housing 41, and also between the top surface 31*d* of the dynamic speaker 31 and the pressure part 421 of the cover 42.

The first guide groove 31*f* is formed in the diameter direction on the top surface 31*d*, and in the height direction (Z-axis direction) on the periphery surface 31*e*. The guide grooves 31*f* formed on the top surface 31*d* and periphery surface 31*e* are connected to each other. The first guide groove 31*f* is constituted as a square groove, but it may be constituted as a concave groove of round or other shape. The position at which the first guide groove 31*f* is formed is not limited in any way, but preferably it is provided at a position close to the terminal 333 on the circuit board 33, as shown in FIG. 3.

It should be noted that, if the pressure part 421 of the cover 42 is constituted by multiple pillars, the wiring members C3 can be guided between these pillars and therefore formation of guide groove 31*f* on the top surface 31*d* can be omitted.

On the other hand, a second guide groove 34*a* that can house multiple wiring members C3 is provided on the support surface 341 of the ring-shaped member 34. The second guide groove 34*a* is formed linearly in the diameter direction so as to connect the inner periphery and outer periphery of the ring-shaped member 34. The second guide groove 34*a* is formed at a position where it connects to the first guide groove 31*f* in a condition where the sounding unit 30 is assembled into the housing 41. This way, the wiring members C3 can be wired easily without risking damage between the leg 312*a* of the dynamic speaker 31 and the ring-shaped member 34.

[Earphone Operation]

Next, a typical operation of the earphone 100 of this embodiment as constituted above is explained.

With the earphone 100 of this embodiment, playback signals are input to the circuit board 33 of the sounding unit 30 via the wiring member C1. The playback signals are input to the dynamic speaker 31 and piezoelectric speaker 32 via the circuit board 33 and wiring members C2, C3, respectively. As a result, the dynamic speaker 31 is driven, to generate low-pitch sound waves primarily of 7 kHz or below. With the piezoelectric speaker 32, on the other hand, the vibration plate 321 vibrates due to the expansion/contraction action of the piezoelectric element 322, to generate high-pitch sound waves primarily of 7 kHz or above. The generated sound waves in different bands are transmitted to the user's ear via the sound path 11. This way, the earphone 100 functions as a hybrid speaker having a speaker for low-pitch sounds and speaker for high-pitch sounds.

Here, the sound waves generated by the sounding unit 30 are formed by composite waves having a sound wave component that is generated by the piezoelectric speaker 32 and that propagates to the second space S2, and a sound wave component that is generated by the dynamic speaker 31 and propagates to the second space S2 via the holes 35, 36, 37. Accordingly, low-pitch sound waves output from the piezoelectric speaker 32 can be adjusted or tuned to frequency characteristics that give a sound pressure peak in a specified low-pitch sound band, for example, by optimizing the constitution of the holes 35, 36, 37 in the vibration plate 321.

In this embodiment, the holes 35, 36, 37 are constituted by through holes penetrating the vibration plate 321 in its thickness direction, so the sound wave propagation path from the first space S1 to the second space S2 can be minimized (made the shortest). This makes it easier to set a sound pressure peak in a specified low-pitch sound range.

Also, the holes 35, 36, 37 in the vibration plate 321 function as low-pass filters that cut, from among the sound waves generated by the dynamic speaker 31 those high-frequency components of or above a specified level. This way, sound waves in a specified low-frequency band can be output without affecting the frequency characteristics of high-pitch sound waves generated by the piezoelectric speaker 32.

Furthermore, according to this embodiment, the piezoelectric speaker 32 is constituted in a manner leading all of the multiple wiring members C3 toward the first principle surface 32*a* side of the vibration plate 321, which improves not only the ease of connecting the wiring members C3 to the piezoelectric element 322, but also the ease of assembly to the housing 41, compared to when the wires are led out from the second principle surface 32*b* side of the vibration plate 321.

Moreover, the sounding unit 30 allows the dynamic speaker 31 and piezoelectric speaker 32 to be assembled into the housing 41 at once while being connected to each other via the wiring members C3, which improves the ease of assembly further. Also, the first and second guide grooves 31*f*, 34*a* that can house the wiring members C3 are provided on the periphery surface 31*e* of the dynamic speaker 31 and the support surface 341 of the ring-shaped member 34, respectively, which allows for wiring of the wiring members C3 through proper paths without risking damage. This way, stable assembly accuracy can be ensured without requiring mastery of work.

Variation Example 1

FIG. 9 is a lateral section view showing a rough constitution of the earphone 100 as an electroacoustic transducer pertaining to Variation Example 1 of the aforementioned embodiment. The constitution of the earphone 100 pertaining to Variation Example 1 is the same as in the aforementioned embodiment other than structures described below, and therefore its explanation is skipped as deemed appropriate. Also, the earphone 100 pertaining to Variation Example 1 is assigned the same symbols where its constitution corresponds to the aforementioned embodiment.

With the earphone 100 pertaining to Variation Example 1, the input terminals 327*a*, 327*b* are both provided on the first principle surface 322*a* of the piezoelectric element 322.

FIG. 10 is a perspective view showing a rough constitution of the piezoelectric element 322, while FIG. 11 is a section view of the piezoelectric element 322 in FIG. 10, cut along line D-D'.

With the piezoelectric element 322, the first leader electrode layer 325*a* to connect the first input terminal 327*a* and first external electrode 326*a*, and the second leader electrode layer 325*b* to connect the second input terminal 327*b* and second external electrode 326*b*, are both provided on the first principle surface 322*a*. The leader electrode layers 325*a*, 325*b* are away from each other.

The input terminals 327*a*, 327*b* are directly provided on the leader electrode layers 325*a*, 325*b*, respectively. In other words, the input terminals 327*a*, 327*b* that receive input of playback signals via the wiring members C3 are connected to the external electrodes 326*a*, 326*b* via the leader electrode layers 325*a*, 325*b*, respectively.

Even according to this constitution of Variation Example 1, the piezoelectric speaker 32 can generate sound waves based on the playback signals that have been input to the input terminals 327*a*, 327*b* from the circuit board 33 via the wiring members C3.

Variation Example 2

The constitution of the earphone pertaining to Variation Example 2 is the same as that of the earphone 100 pertaining to Variation Example 1 other than structures described below, and therefore its explanation is skipped as deemed appropriate. Also, the earphone pertaining to Variation Example 2 is assigned the same symbols where its constitution corresponds to the earphone 100 pertaining to Variation Example 1.

FIG. 12 is a perspective view showing a rough constitution of the piezoelectric element 322, while FIG. 13 is a plan view showing a rough constitution of the piezoelectric speaker 32.

With the piezoelectric element 322 pertaining to Variation Example 2, the first leader electrode layer 325*a* is connected to the first external electrode 326*a* only at one end in the Y-axis direction, while the second leader electrode layer 325*b* is connected to the second external electrode 326*b* only at the other end in the Y-axis direction. In other words, the connection part of the first leader electrode layer 325*a* and first external electrode 326*a* is positioned diagonally across from the connection part of the second leader electrode layer 325*b* and second external electrode 326*b* on the rectangular first principle surface 322*a*.

The external electrodes 326*a*, 326*b* are formed smaller than in the aforementioned embodiment, not covering the entire end faces of the base body 328 but covering only around the connection parts of the leader electrode layers 325*a*, 325*b*. The holes 35, 36 in the vibration plate 321 are formed smaller than in the aforementioned embodiment, corresponding to the position and shape of the external electrodes 326*a*, 326*b*.

As described above, the constitution of the holes 35, 36 in the vibration plate 321 can be changed in various ways according to the position and shape of the external electrodes 326*a*, 326*b* of the piezoelectric element 322, to support piezoelectric elements 322 of any and all constitutions.

Two third holes 37 are placed at positions facing the hole 35, and another two at positions facing the hole 36, across the piezoelectric element 322. As a whole, the holes 35, 36, 37 are point-symmetrical to one another across the center point of the vibration plate 321. This way, the vibration plate 321 vibrates more isotropically, to allow the vibration plate 321 to generate better sound waves.

Additionally, when the holes 35, 36 are small, the number of third holes 37 may be increased or the third holes 37 may be formed larger to improve the sound-passing property with respect to the sound waves generated by the dynamic speaker 31.

Second Embodiment

FIG. 14 is a lateral section view showing a rough constitution of the earphone 100 as an electroacoustic transducer pertaining to the second embodiment of the present invention. The constitution of the earphone 100 pertaining to the second embodiment is the same as in the first embodiment other than structures described below, and therefore its explanation is skipped as deemed appropriate. Also, the earphone 100 pertaining to the second embodiment is assigned the same symbols where its constitution corresponds to the first embodiment.

FIG. 15 is a perspective view showing a rough constitution of the piezoelectric element 322 pertaining to this embodiment, while FIG. 16 is a section view of the piezoelectric element 322 in FIG. 15, cut along line E-E'.

With the piezoelectric element 322, the first external electrode 326*a* is formed by the dip method as in the first embodiment. On the other hand, the second external electrode 326*b* is formed by the application method, sputtering method, or other method different from the dip method, unlike in the first embodiment. As a result, although the first external electrode 326*a* has the first convex part 329*a* protruding from the second principle surface 322*b*, the second external electrode 326*b* does not have the second convex part 329*b* protruding from the second principle surface 322*b*.

FIG. 17 is a plan view showing a rough constitution of the vibration plate 321, while FIG. 18 is a plan view showing a rough constitution of the piezoelectric speaker 32 constituted by the piezoelectric element 322 joined to this vibration plate 321.

Although the conductive body of the vibration plate 321 has the first hole 35 formed in it as in the first embodiment, no second hole 36 is formed, unlike in the first embodiment. In other words, the second external electrode 326*b* is flat on the second principle surface 322*b*, and therefore the first principle surface 32*a* of the vibration plate 321 is not interfered with in making surface contact with the second principle surface 322*b* of the piezoelectric element 322, even if no second hole 36 is provided.

FIG. 19 is a partial section view of the piezoelectric speaker 32 in FIG. 18, cut along line F-F'. In the first hole 35 in the vibration plate 321, a sealing part 351 filled with insulating resin is provided. The first convex part 329*a* of the first external electrode 326*a* is fixed to the sealing part 351 inside the first hole 35. This way, the first external electrode 326*a* is more reliably insulated from the body of the vibration plate 321 by the sealing part 351.

Also, as shown in FIG. 18, sealing the first hole 35 with the sealing part 351 reduces the impact of the vibration plate 321 on the vibration characteristics resulting from providing the first hole 35 in the vibration plate 321. Particularly in this embodiment where no second hole 36 is provided in the vibration plate 321, which makes it easy for the vibration of the vibration plate 321 to lose isotropy due to the first hole 35, the action of the sealing part 351 filled in the first hole 35 maintains isotropy of the vibration of the vibration plate 321.

The third holes 37 in the vibration plate 321 are formed as slots along the four sides of the piezoelectric element 322, respectively. In other words, with the vibration plate 321 pertaining to this embodiment the number of third holes 37 is greater, and each third hole 37 is larger, than in the first embodiment. This way, the vibration plate 321 can ensure high sound-passing property with respect to the sound waves generated by the dynamic speaker 31, even though the first hole 35 is not a through-hole and there is no second hole 36.

The foregoing explained embodiments of the present invention, but the present invention is not limited to the aforementioned embodiments and it goes without saying that various modifications may be added.

For instance, the above embodiments were explained by citing an example of a hybrid speaker equipped with a dynamic speaker 31 and piezoelectric speaker 32, but the present invention can also be applied to an electroacoustic transducer equipped only with a piezoelectric speaker. In addition, the present invention can also be applied to an electroacoustic transducer equipped with a sounding body different from a piezoelectric speaker 32 or dynamic speaker 31.

Also, in the aforementioned embodiments the sound-passing parts that guide low-pitch sound waves to the sound path were provided in the piezoelectric speaker; however, the sound-passing parts are not limited to the foregoing and may be provided around the piezoelectric speaker. In this case, the outer diameter of the piezoelectric speaker U2 is formed smaller than the inner diameter of the side wall of the housing B, as shown schematically in FIG. 20, for example, and sound-passing parts T through which to pass low-pitch sound waves generated by the dynamic speaker U1 are formed between the two. It should be noted that the piezoelectric speaker U2 is fixed to the bottom B1 of the housing B via multiple support pillars R. This way sound waves passing through the sound-passing parts T can be guided to the sound path B2.

Furthermore, the aforementioned embodiments were explained using the earphone 100 as an example of the electroacoustic transducer, but the present invention is not limited to the foregoing and can also be applied to headphones, hearing aids, etc. In addition, the present invention can also be applied as speaker units installed in mobile information terminals, personal computers, and other electronic devices.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2014-255300, filed Dec. 17, 2014 the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A piezoelectric speaker, comprising:

a piezoelectric element having a base body with a mounting surface, as well as first and second external electrodes formed on the mounting surface with a distance between the first and second external electrodes; and a vibration plate having a conductive body which is joined to the piezoelectric element and has a principle surface facing the mounting surface, as well as a first hole with or without a bottom which is formed on the principle surface in a region facing the first external electrode to form a space between the conductive body and first external electrode.

2. A piezoelectric speaker according to claim 1, wherein the second external electrode has a convex part protruding beyond a plane of the mounting surface and the vibration plate has a second hole with or without bottom which engages with the convex part.

3. A piezoelectric speaker according to claim 2, wherein the second hole has a regulation part that regulates a relative position of the convex part with respect to the body.

4. A piezoelectric speaker according to claim 2, wherein the first hole and second hole are formed at positions that are line-symmetrical or point-symmetrical to each other.

5. A piezoelectric speaker according to claim 3, wherein the first hole and second hole are formed at positions that are line-symmetrical or point-symmetrical to each other.

6. A piezoelectric speaker according to claim 1, wherein the vibration plate further has one or multiple third holes penetrating the plate in its thickness direction.

7. A piezoelectric speaker according to claim 2, wherein the vibration plate further has one or multiple third holes penetrating the plate in its thickness direction.

8. A piezoelectric speaker according to claim 3, wherein the vibration plate further has one or multiple third holes penetrating the plate in its thickness direction.

9. A piezoelectric speaker according to claim 4, wherein the vibration plate further has one or multiple third holes penetrating the plate in its thickness direction.

10. A piezoelectric speaker according to claim 6, wherein the principle surface is circular and the mounting surface is polygonal.

11. A piezoelectric speaker according to claim 1, wherein insulating resin is filled in the first hole.

12. A piezoelectric speaker according to claim 2, wherein insulating resin is filled in the first hole.

13. A piezoelectric speaker according to claim 3, wherein insulating resin is filled in the first hole.

14. A piezoelectric speaker according to claim 4, wherein insulating resin is filled in the first hole.

15. A piezoelectric speaker according to claim 5, wherein insulating resin is filled in the first hole.

16. A piezoelectric speaker according to claim 6, wherein insulating resin is filled in the first hole.

17. An electroacoustic transducer, comprising:

a housing;

a piezoelectric element having a base body with a mounting surface, as well as first and second external electrodes formed on the mounting surface with a distance between the first and second external electrodes;

a vibration plate having a conductive body supported by the housing, joined to the piezoelectric element, and having a principle surface facing the mounting surface, as well as a through hole which is formed on the principle surface in a region facing the first external electrode to form a space between the conductive body and first external electrode; and a dynamic speaker housed in the housing and placed in a manner facing the vibration plate.

18. An electroacoustic transducer according to claim 17, wherein the through hole is constituted as a sound-passing part to let sound waves generated by the dynamic speaker pass through.

* * * * *